US010904656B2

(12) United States Patent
Ludwig et al.

(10) Patent No.: US 10,904,656 B2
(45) Date of Patent: Jan. 26, 2021

(54) VEHICLE SPEAKER ARRAGEMENT

(71) Applicant: HARMAN INTERNATIONAL INDUSTRIES, INCORPORATED, Stamford, CT (US)

(72) Inventors: Christopher Ludwig, Birmingham, MI (US); Riley Winton, Canton, MI (US); Jung Wook Hong, Northville, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/301,025

(22) PCT Filed: May 10, 2017

(86) PCT No.: PCT/US2017/031895
§ 371 (c)(1),
(2) Date: Nov. 13, 2018

(87) PCT Pub. No.: WO2017/196935
PCT Pub. Date: Nov. 16, 2017

(65) Prior Publication Data

US 2019/0182584 A1 Jun. 13, 2019

Related U.S. Application Data

(60) Provisional application No. 62/334,154, filed on May 10, 2016.

(51) Int. Cl.

| | |
|---|---|
| ***H04R 1/28*** | (2006.01) |
| ***H04R 1/22*** | (2006.01) |
| ***H04R 1/02*** | (2006.01) |

(52) U.S. Cl.
CPC ..... *H04R 1/2849* (2013.01); *H04R 1/026* (2013.01); *H04R 1/22* (2013.01); *H04R 1/2869* (2013.01);
(Continued)

(58) Field of Classification Search
None
See application file for complete search history.

(56) References Cited

U.S. PATENT DOCUMENTS

| | | | |
|---|---|---|---|
| 4,085,289 | A | 4/1978 | Schmideler |
| 5,218,175 | A | 6/1993 | Scarlata |

(Continued)

FOREIGN PATENT DOCUMENTS

| | | | |
|---|---|---|---|
| CN | 203491984 | U | 3/2014 |
| CN | 104221399 | A | 12/2014 |

(Continued)

OTHER PUBLICATIONS

Olson, H. Elements of Acoustical Engineering, 1940, D. Yan Nostrand Company Inc., pp. 60-69 and 127-133.

(Continued)

*Primary Examiner* — Qin Zhu
(74) *Attorney, Agent, or Firm* — Brooks Kushman P.C.

(57) ABSTRACT

An audio system for a vehicle is provided having a bass-range speaker mounted in a vehicle cavity. The speaker has a front side for producing an acoustic output in a passenger compartment of the vehicle. The vehicle cavity encloses a back side of the speaker. A duct having a first end is in fluid communication with the vehicle cavity and a second end is in fluid communication with the atmosphere outside the vehicle.

19 Claims, 5 Drawing Sheets

(52) U.S. Cl.
CPC .... *H04R 2201/021* (2013.01); *H04R 2499/13* (2013.01)

(56) References Cited

U.S. PATENT DOCUMENTS

| | | | | |
|---|---|---|---|---|
| 6,354,651 | B1 * | 3/2002 | Mori | B60R 16/0222 174/152 G |
| 6,868,937 | B2 | 3/2005 | Cass | |
| 6,955,241 | B2 | 10/2005 | Thorsell et al. | |
| 7,628,249 | B2 | 12/2009 | Hanna | |
| 8,044,413 | B2 | 10/2011 | Albus et al. | |
| 8,130,976 | B2 | 3/2012 | Linhard et al. | |
| 8,139,783 | B2 | 3/2012 | Schuster et al. | |
| 8,469,447 | B2 | 6/2013 | Baker | |
| 8,649,548 | B1 | 2/2014 | Weber et al. | |
| 8,708,092 | B2 | 4/2014 | Ito et al. | |
| 8,776,944 | B2 | 7/2014 | Ito et al. | |
| 8,804,991 | B2 | 8/2014 | Velican | |
| 8,837,762 | B2 | 9/2014 | Tada et al. | |
| 8,837,768 | B2 | 9/2014 | Subat et al. | |
| 9,025,790 | B2 | 5/2015 | Tada et al. | |
| 9,549,243 | B2 | 1/2017 | Stys et al. | |
| 9,820,033 | B2 | 11/2017 | Dix et al. | |
| 2001/0030078 | A1 | 10/2001 | Jones et al. | |
| 2003/0183444 | A1 | 10/2003 | Cass | |
| 2003/0215101 | A1 | 11/2003 | Stuart et al. | |
| 2004/0141625 | A1 | 7/2004 | Leipold | |
| 2004/0202337 | A1 | 10/2004 | Jun | |
| 2005/0100173 | A1 | 5/2005 | Eid et al. | |
| 2005/0218694 | A1 | 10/2005 | Schoemann et al. | |
| 2006/0151910 | A1 | 7/2006 | Schoemann et al. | |
| 2007/0154055 | A1 | 7/2007 | Nichols et al. | |
| 2008/0101646 | A1 | 5/2008 | Holmi | |
| 2008/0240474 | A1 | 10/2008 | Sakamoto et al. | |
| 2009/0110210 | A1 | 4/2009 | Ludwig et al. | |
| 2009/0154726 | A1 | 6/2009 | Taenzer | |
| 2009/0220112 | A1 | 9/2009 | Fincham | |
| 2011/0142251 | A1 | 6/2011 | Rosen | |
| 2012/0106748 | A1 | 5/2012 | Peachey et al. | |
| 2012/0219171 | A1 | 8/2012 | Velican | |
| 2013/0188806 | A1 | 7/2013 | Tada | |
| 2013/0272537 | A1 | 10/2013 | Tada et al. | |
| 2013/0284536 | A1 | 10/2013 | Ito et al. | |
| 2014/0055258 | A1 | 2/2014 | Große-Budde | |
| 2014/0270270 | A1 | 9/2014 | Ito | |
| 2015/0030178 | A1 | 1/2015 | Sulowski | |
| 2015/0036840 | A1 | 2/2015 | Sulowski et al. | |
| 2015/0098586 | A1 | 4/2015 | Tanabe | |
| 2016/0016513 | A1 | 1/2016 | Di Censo et al. | |

FOREIGN PATENT DOCUMENTS

| | | | |
|---|---|---|---|
| DE | 19909143 | A1 | 11/2000 |
| DE | 102008015490 | A1 | 10/2009 |
| DE | 102011105474 | A1 | 12/2012 |
| DE | 202013105629 | A1 | 7/2014 |
| DE | 102013020672 | A1 | 8/2014 |
| EP | 0904985 | A1 | 3/1999 |
| EP | 1266799 | A1 | 12/2002 |
| EP | 1407934 | A1 | 4/2004 |
| EP | 1773092 | A2 | 4/2007 |
| EP | 2043382 | A1 | 4/2009 |
| EP | 2077680 | A1 | 7/2009 |
| EP | 2211562 | A1 | 7/2010 |
| EP | 2530835 | A1 | 12/2012 |
| EP | 2620328 | A1 | 7/2013 |
| EP | 2654319 | A2 | 10/2013 |
| EP | 2858377 | A1 | 4/2015 |
| JP | S63287269 | A | 11/1988 |
| JP | H07-267003 | A | 10/1995 |
| JP | H07-304398 | A | 11/1995 |
| JP | H08-253082 | A | 10/1996 |
| JP | 2002240643 | A | 8/2002 |
| JP | 2007106281 | A | 4/2007 |
| JP | 2007267003 | A | 10/2007 |
| JP | 2012121455 | A | 6/2012 |
| JP | 2013229730 | A | 11/2013 |
| WO | 2011047435 | A1 | 4/2011 |
| WO | 2016123360 | A1 | 8/2016 |

OTHER PUBLICATIONS

Gettleman et al., "Boys who died lived 17 hours in car trunk, lawyer says." pp. 1-4 Jul. 19, 2005. https://www.nytimes.com/2005/07/19/nyregion/boys-who-died-lived-17-hours-in-car-trunk-lawyer-says.html.

DIYmobileaudio, "another infinite baffle thread." pp. 1-32. Oct. 4, 2011. https://www.diymobileaudio.com/forum/build-logs-project-install-gallery/115050-another-infinite-baffle-thread-3-12s-2007-honda-accord.html.

Office Action of Chinese Application No. 201780029171.9 dated Sep. 3, 2019, 11 pages.

Third Party Observations for European Application No. 17725406.7, dated Nov. 14, 2019, 5 pages.

XC90 Bowers & Wilkins Premium Sound Master, <URL: https://vimeo.com/149821145>, Dec. 22, 2015(NA), 2 pages.

Jon beyer volvo, <URL: http://donbeyervolvoxc90.com/audiosystem/>, Oct. 13, 2014(NA), 2 pages.

Beissmann, Tim, Volvo Concept You unveiled at 2011 Frankfurt Motor Show, Sep. 13, 2011, [retrieved Mar. 3, 2020] Retrieved from the Internet <URL: https://www.caradvice.com.au/137766/volvo-concept-you-unveiled-at-2011-frankfurt-motor-show/>, 5 pages.

Examination Report for European Application No. 17725406.7, dated Feb. 18, 2020, 5 pages.

* cited by examiner

VEHICLE SPEAKER ARRAGEMENT

CROSS-REFERENCE TO RELATED APPLICATION

This application is the U.S. national phase of PCT Application No. PCT/US2017/031895 filed on May 10, 2017, which claims the benefit of U.S. Provisional Application No. 62/334,154 filed on May 10, 2016, the disclosures of which are incorporated in their entirety by reference herein.

TECHNICAL FIELD

The present disclosure generally relates to loudspeakers systems having at least one bass-range, low frequency speaker. More particularly, the present disclosure relates to vehicles having a bass-range speaker.

BACKGROUND

Loudspeakers for producing bass-range, low-frequency sound are utilized in vehicles audio systems. One example is European Patent No. EP1407934 by Harman Becker Automotive Systems GmbH.

SUMMARY

According to at least one embodiment, an audio system for a vehicle is provided having a bass-range speaker mounted in a vehicle cavity. The speaker has a front side for producing an acoustic output in a passenger compartment of the vehicle. The vehicle cavity encloses a back side of the speaker. A duct having a first end is in fluid communication with the vehicle cavity and a second end is in fluid communication with the atmosphere outside the vehicle.

According to a further embodiment, the vehicle cavity is formed in a vehicle door.

According to another embodiment, the duct extends from the forward side of the vehicle door across a hinge area between the vehicle door and a body structure of the vehicle.

According to still another embodiment, the second end of the duct is positioned adjacent an opening formed in a wheel well of the vehicle.

According to another embodiment, the second end of the duct is positioned in the engine compartment of the vehicle.

According to a further embodiment, the second end of the duct is in fluid communication with a B-pillar of the vehicle. The B-pillar has an opening in fluid communication with the atmosphere outside the vehicle.

According to another embodiment, at least a portion of the duct is contained in a grommet along the hinge area, and wherein the gromment also contains electrical wiring.

According to yet another embodiment, the duct has a cross-sectional area being at least twenty-five percent of a cone area of the speaker.

According to another embodiment, the speaker is fluidly sealed between the first end and the second end.

According to a further embodiment, at least a portion of the duct is flexible.

According to at least one embodiment, an audio system for a vehicle is provided having a speaker housing mounted in the vehicle. A bass-range speaker is mounted in the housing for producing low frequency acoustic output to a passenger compartment from a front side of the speaker. The housing encloses the back side of the speaker. A duct having a proximal end is fluidly sealed to the housing. The duct extends to a distal end in fluid communication with the atmosphere outside the vehicle.

According to another embodiment, the speaker housing is not a sealed resonance volume, wherein the duct provides an infinite baffle with the atmosphere outside the vehicle.

According to still another embodiment, the speaker is mounted in a door of the vehicle. The duct extends from the forward side of the door across a hinge area between the vehicle door and a forward body structure. The distal end is fluidly connected to an opening in a forward body structure of the vehicle being open to the atmosphere.

According to another embodiment, at least one of the proximal and distal ends of the duct is covered in an acoustic resistive material to minimize noise from the atmosphere in the passenger compartment of the vehicle.

According to a further embodiment, the duct has a cross-sectional area being at least twenty-five percent of a cone area of the speaker.

According to another embodiment, the duct is fluidly sealed between the first end and the second end of the duct.

According to at least one embodiment, a method is provided including mounting a speaker in a cavity in a vehicle. A duct is provided having a first end in fluid communication with the cavity and a second end in fluid communication with the atmosphere outside the vehicle.

According to another embodiment, the duct is routed to extend across a hinge area between a vehicle door and a vehicle body structure.

According to a further embodiment, at least a portion of the duct is routed through a grommet along the hinge area. Electrical wiring is routed through the gromment adjacent the portion of the duct.

According to still another embodiment, the duct has a cross-sectional area being at least twenty-five percent of a cone area of the speaker.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
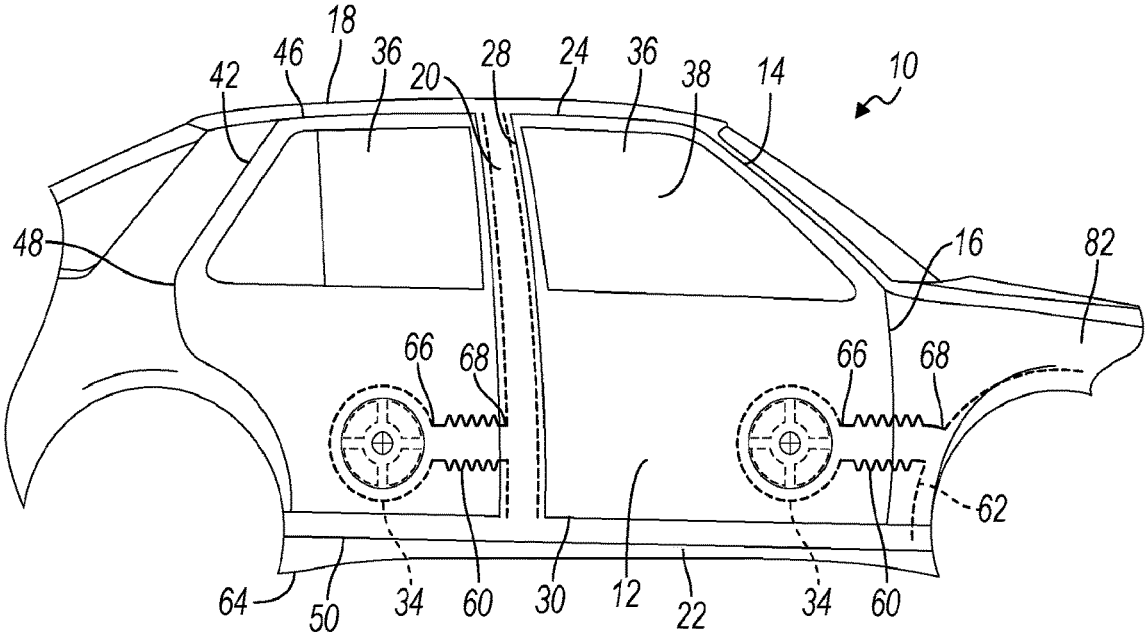
FIG. 1 illustrates a schematic view of an audio system according to an embodiment of the present disclosure.

FIG. 1 illustrates a vehicle 10 having a front door 12 connected to the A-pillar 14 of the vehicle 10 by a hinge along a forward side 16. In addition, the door 12 is framed by a roof support 18, a B-pillar 20 and a sill 22. When the door 12 is closed, an upper side 24 of the door seals with the roof support 18, a rear side 28 of the door seals and latches with the B-pillar 20 and a bottom side 30 seals with the sill 22. A loudspeaker 34 is installed in a cavity in the front door 12.

The vehicle 10 may also have a rear door 42 connected to the B-pillar 20 of the vehicle. The rear door 42 may be connected by a hinge along the B-pillar 20, or may latch along the B-pillar 20 and slide longitudinally or open in another direction. In addition, the rear door 42 is framed by the roof support 18, a C-pillar 44 and the sill 22. When the door 12 is closed, an upper side 46 seals with the roof support 18, a rear side 48 seals and/or latches with the C-pillar 44 and a bottom side 50 seals with the sill 22. A loudspeaker 34 may be similarly installed in a cavity in the rear door 42.

The vehicle includes an audio system having a bass-compatible speaker 34 installed in the doors 12, 42. The speaker 34 is installed in a cavity 54 below the windows 36. The bass-compatible speaker 34 is designed to at least emit sound in a portion of the bass-range in addition to emitting frequencies outside of the bass-range. It is difficult to have a large enough resonant volume in a cavity enclosed by the door underneath the windows because components such as window-lifting mechanisms, wiring, side airbags, locking devices and other vehicle components are located in this area. Therefore, speakers provided in doors without adequate resonant volume cavities may produce inadequate low-frequency output, excessive mechanical vibration and/or other undesirable effects such as buzz, squeak, and rattle. This can be a particular problem for loudspeakers that provide low-frequency sound, such as a bass-compatible speaker, which require a large resonant volume.

A bass-compatible speaker may include a subwoofer, a traditional woofer or other bass speaker that operates in the bass-range. In general, the bass-range is a low frequency range, which may be around 20 Hertz (Hz) to 400 Hz. In the bass-range, subwoofers generally emit sound between 20 Hz and 200 Hz, and traditional woofers generally emit sound between 40 Hz and 400 Hz.

The bass-range sound in the door-mounted speakers 34 is improved by providing a pathway so that the back side of the speaker is in fluid communication with the atmosphere outside of the passenger compartment 38 and/or outside the vehicle. The front side of the speaker refers to the sound-emitting side of the speaker and is generally in fluid communication with the passenger compartment 38 of the vehicle.

As generally shown in FIG. 1, the speakers 34 are in fluid communication with the atmosphere via a duct 60. The front speaker 34 is in fluid communication with the atmosphere via the duct 60 and an opening in the wheel well 62. The duct 60 may also be routed to be in fluid communication with the atmosphere via the engine compartment or anther suitable location. In another embodiment, the back side of the speaker may be in fluid communication an additional cavity or cavities outside of the passenger compartment 38, but within the vehicle via the duct 60.

The rear speaker 34 is in fluid communication with the atmosphere via the duct 60 and an opening in the B-pillar 20 along the underside 64 of the vehicle. The duct 60 may also be routed to be in fluid communication with the atmosphere via the sill, for sliding rear door applications, or another suitable location.

When the back side of the speaker is in fluid communication with the atmosphere outside of the vehicle, the speaker is considered to have an infinite baffle. One benefit of having the back side of the speaker in fluid communication with the open atmosphere is that undesirable resonances in the speaker are reduced because sound waves emitted from the back side of the speaker do not interfere with sound waves emitted from the front side of the speaker. Additionally, another benefit of the open environment, or infinite baffle, is that strain in the diaphragm is reduced because the back side of the speaker vents to the outside atmosphere. As a result, the speaker open to the atmosphere outside the vehicle produces a higher sound pressure level (SPL) at low frequency ranges inside the vehicle.

Another benefit of having the back side of the speaker in fluid communication with the open atmosphere is that sealed speaker enclosures within the door can be eliminated. Removing sealed speaker enclosures reduces cost, complexity and weight. Even in designs where the volume of the door cavity itself provides a resonant volume, like in European Patent EP1407934, door treatments that are required prove a sealed resonance volume can be eliminated. By not requiring the door components to provide a sealed cavity, manufacturability is increased, also providing cost and component savings.

Figure 2:
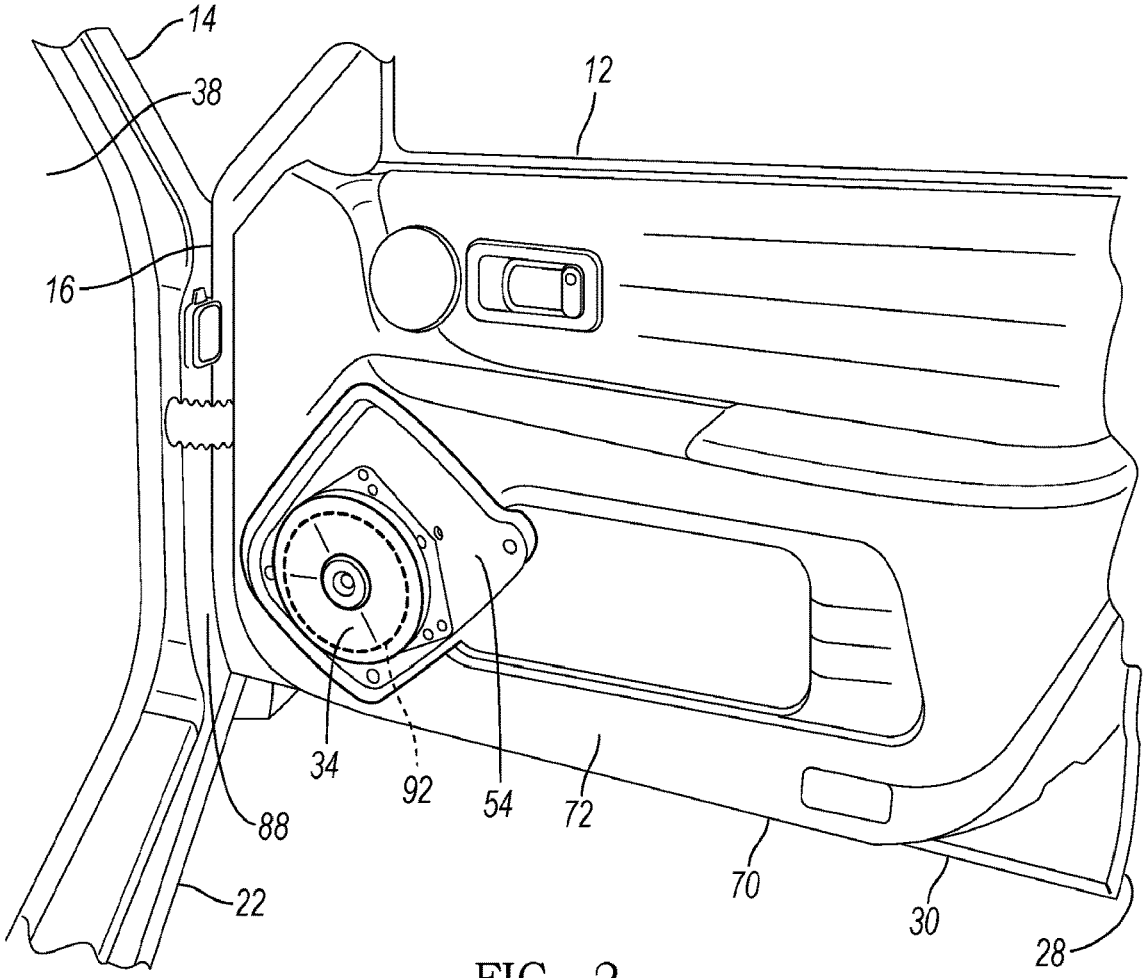
FIG. 2 illustrates a portion of the audio system of FIG. 1, showing the interior of a side door having a speaker.

FIG. 2 shows the interior 70 of the front side door 12 that faces the passenger compartment 38. The side door 12 has a speaker mounting cavity 54 or mounting location. The speaker housing 74 and speaker 34 are mounted to the interior 70 of the door with fasteners 78 at the speaker cavity 54. FIG. 2 also illustrates the hinge area 88 when the vehicle door 12 is in a hinged open position.

Figure 3:
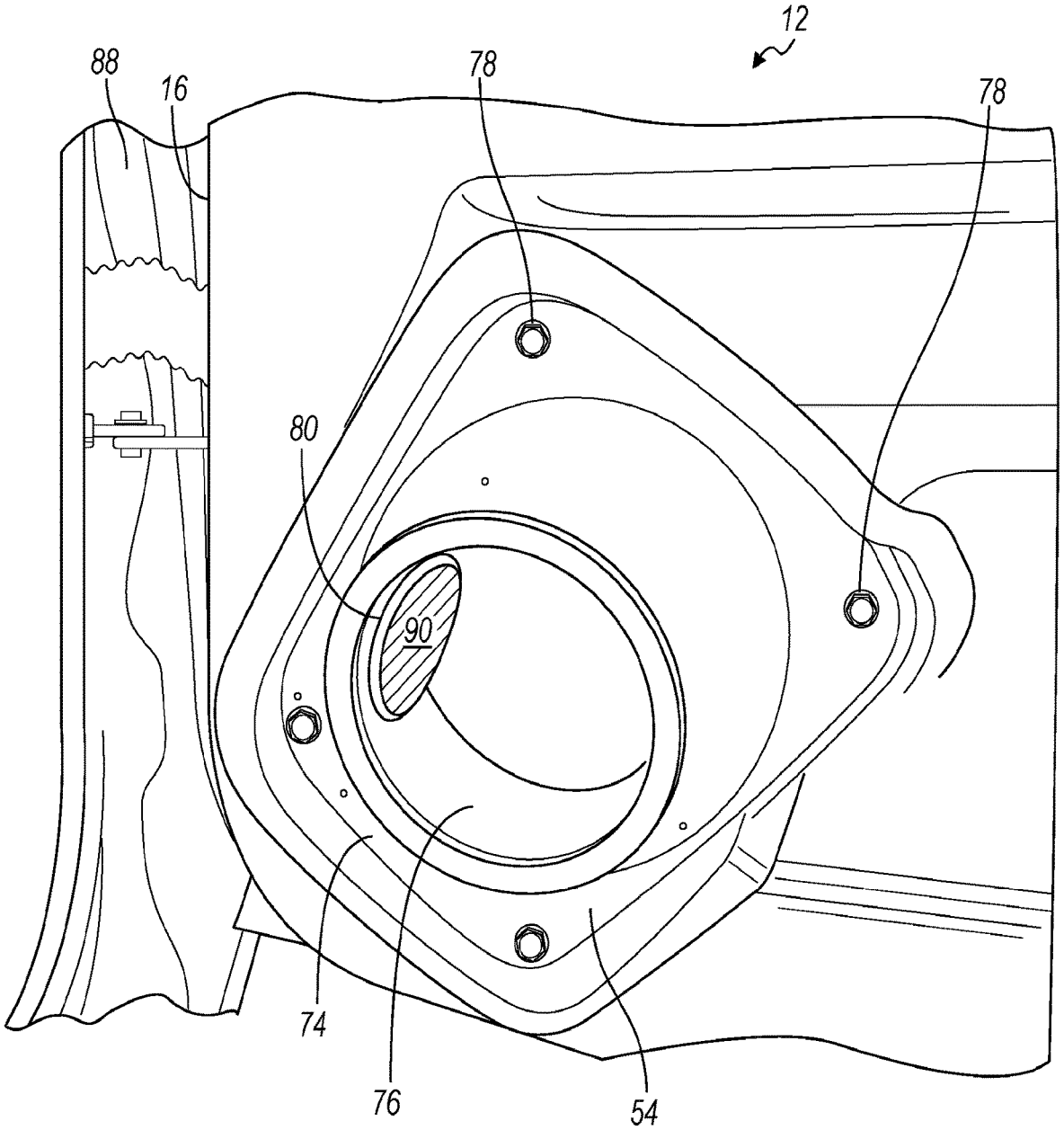
FIG. 3 illustrates a portion of the audio system of FIG. 1, showing the interior of the side door with the speaker removed in more detail.

FIG. 3 shows the interior 70 of the front side door 12 in more detail with the speaker removed. The speaker housing 74 has a receptacle 76 for receiving the speaker. An outlet aperture 80 is defined along a surface of the housing receptacle 76. The outlet aperture 80 may be positioned closer to the forward side 16 of the door 12. FIG. 3 further illustrates the hinge area 88 in closer detail when the vehicle door 12 is in the hinged open position. The duct 60 may be flexible to accommodate movement required along the hinged opening 88 when the door 34 moves between hinged open and closed positions.

Figure 4:
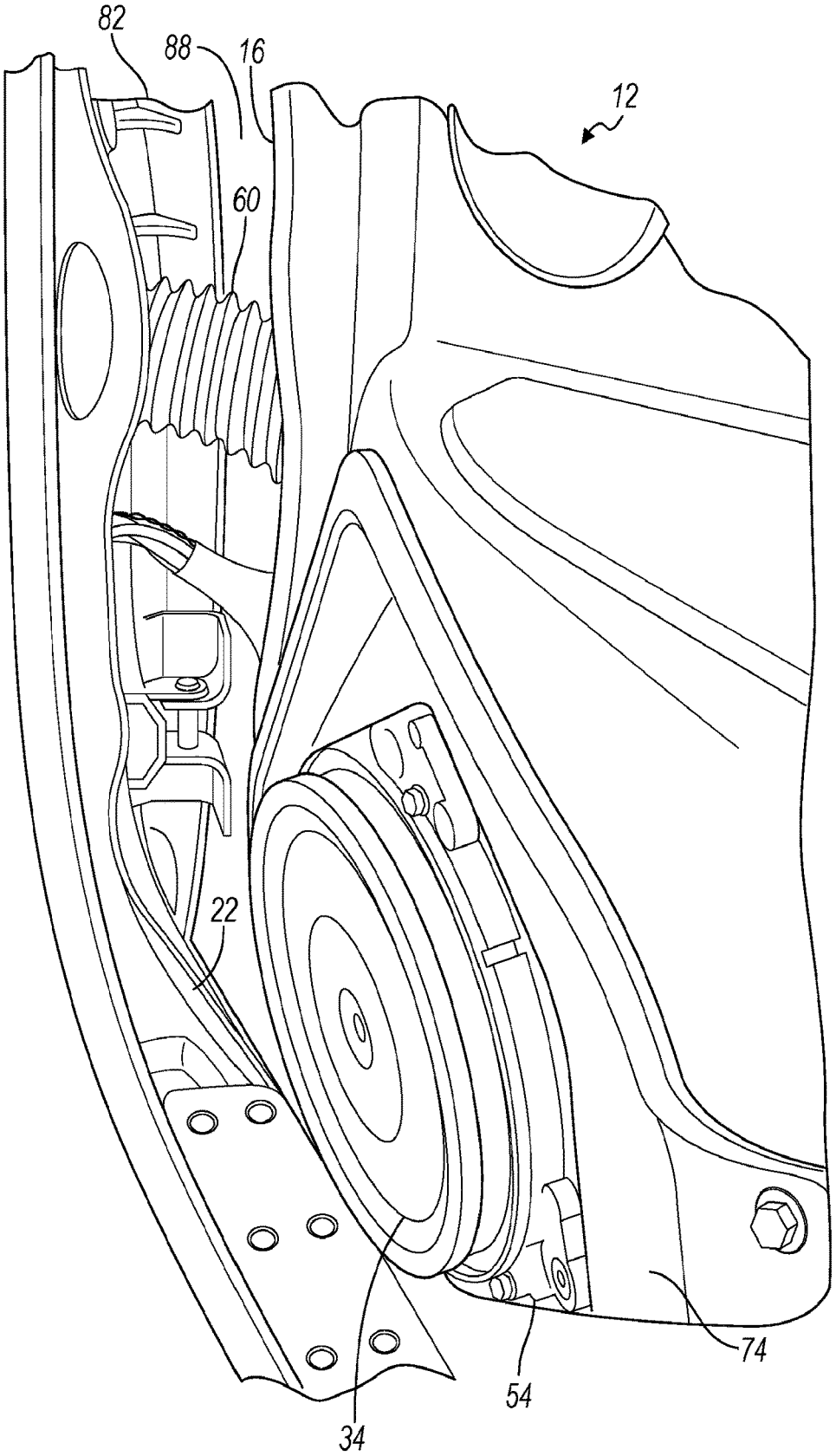
FIG. 4 illustrates a portion of the audio system of FIG. 1, showing the interior of the side door and speaker in more detail.

FIG. 4 further illustrates the speaker 34 and hinge area 88 in more detail when the vehicle door 12 is in the hinged open position. A duct 60 is coupled to the aperture 80 at a first end 66 and is routed toward the forward side 16 of the door 12. The duct 60 may be sealed to the aperture 80 with adhesive or sealed by any suitable method. Alternatively, the duct 60 may be formed as a single piece with the housing 74. The duct 60 is fluidly sealed between the first end 66 and second end 68 (FIG. 1) in order to prevent sound from the back side of the speaker from entering the passenger compartment and to be only in fluid communication with the atmosphere outside the vehicle without leaks that may cause vibrations or may diminish speaker performance and/or output.

The duct 60 extends from the forward side 16 of the door 12 to the front body 82 of the vehicle 10. The duct 60 extends to an opening in the front vehicle body 82 that is open and in fluid communication with the atmosphere. For example, the second end of the duct 60 may extend to an opening in the wheel well 62, as shown in FIG. 1. The opening in the wheel well 62 may be concealed, so that it is not easily visible from outside the vehicle. Similarly, the duct 60 may be routed along the front of the vehicle to an opening in the engine compartment. By visually concealing the second end of the duct 60, the aesthetics and design characteristics of the vehicle are not affected.

Figure 5:
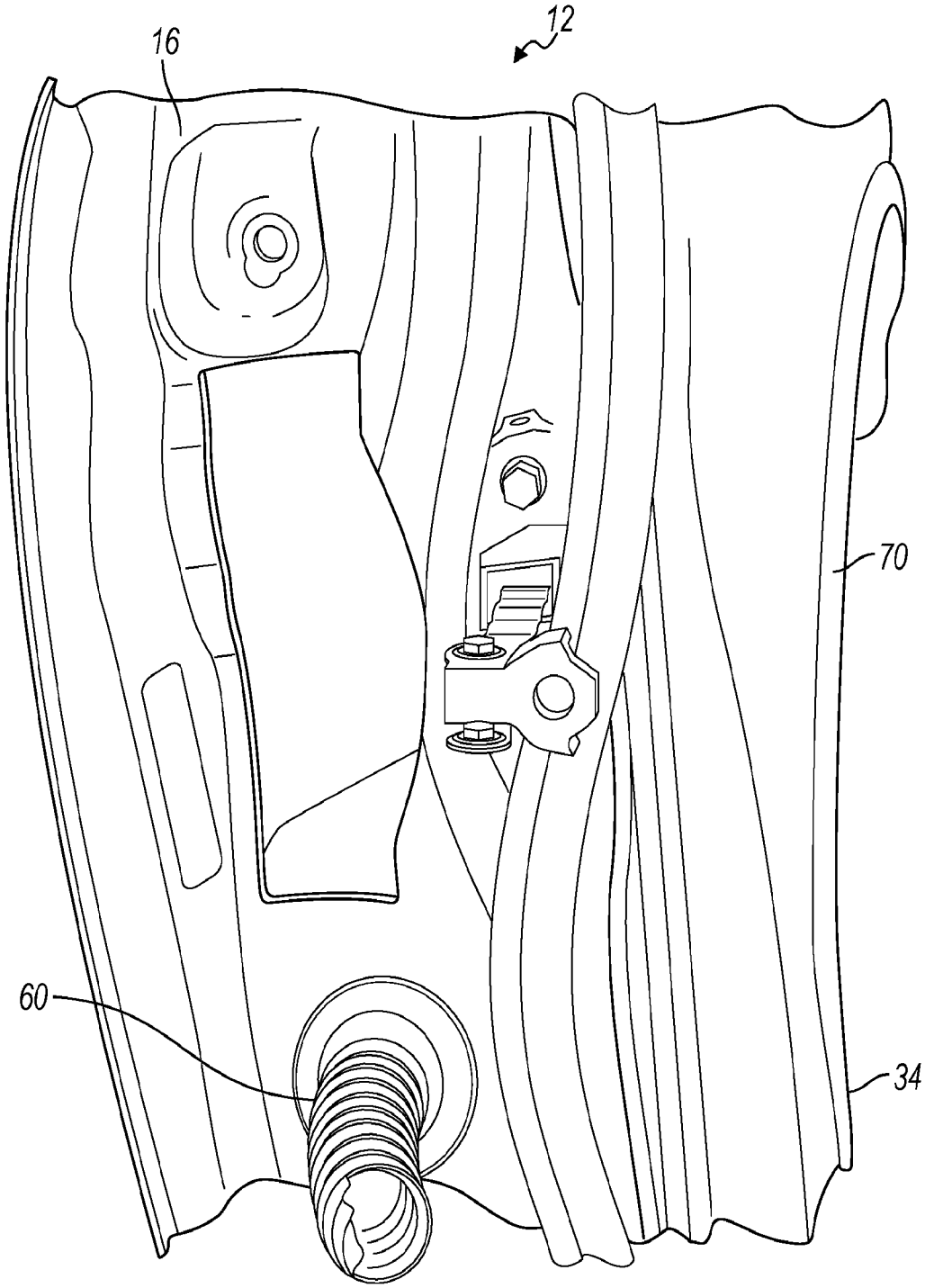
FIG. 5 illustrates a portion of the audio system of FIG. 1, showing a front view of the side door.
Figure 6:
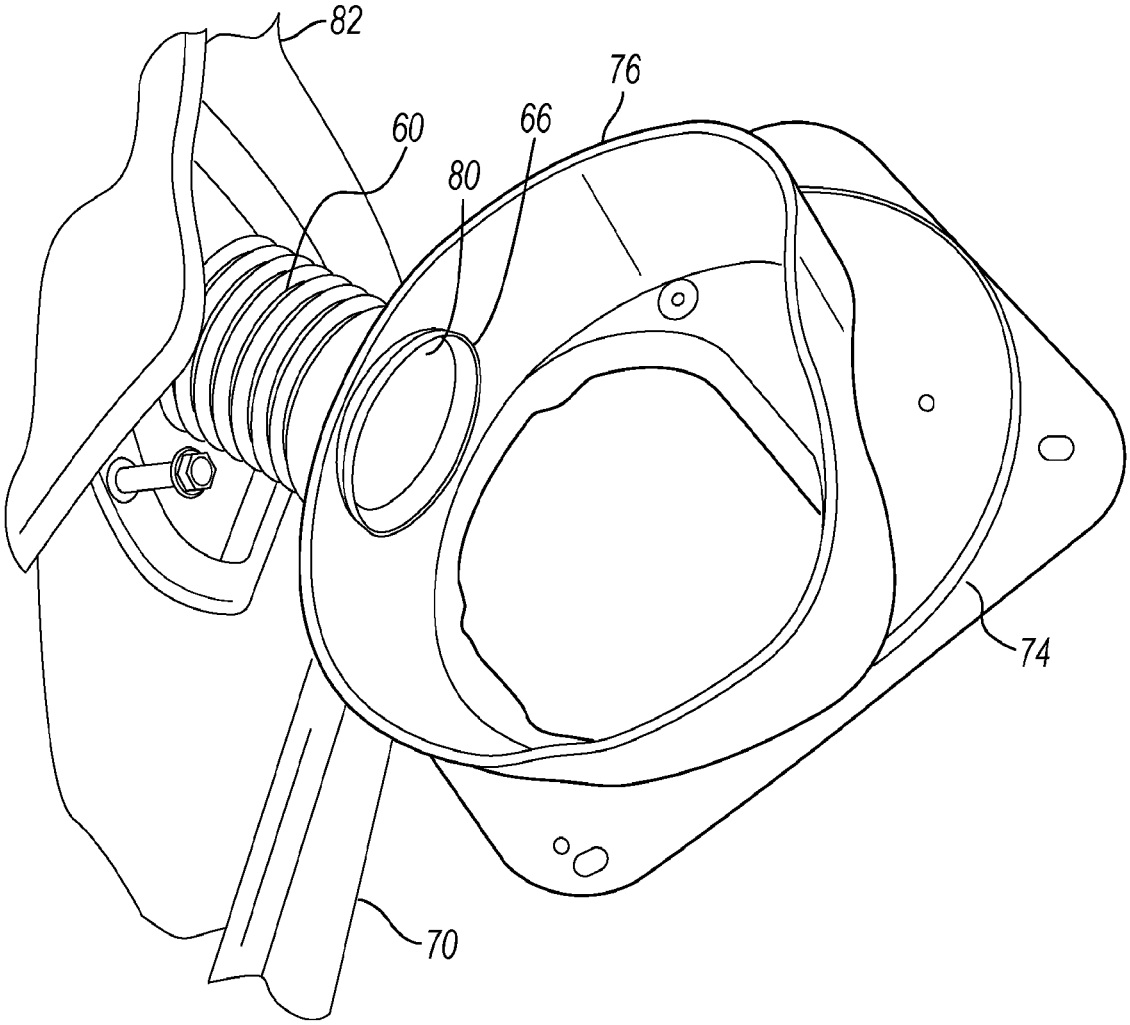
FIG. 6 illustrates a portion of the audio system of FIG. 1, showing the interior of the side door with the speaker housing and vent tube separated from the side door.

As shown better in FIGS. 4-6, the duct 60 may be formed of flexible rubber hose or grommet material. The duct 60 is able to bend and extend across the hinge area 88 between the forward side 16 of the door 12 and the front body 82 of the vehicle as the door 12 opens and closes. Vehicles may have grommet or hose that extends from between the door and the body that contains electrical wiring for controlling door functions such as the electric window and locks. The duct 60 may include the wiring, or may be a separate hose.

FIG. 6 illustrates the speaker housing 74 removed from the vehicle door. As shown in FIG. 6, the speaker housing 74 is not a sealed resonance volume. The speaker housing 74 has a receptacle 76 for receiving the speaker 34 from the interior 70 of the vehicle. The speaker housing 74 may also have a exterior opening.

In order to effectively vent the speaker to the atmosphere, the cross-sectional area 90 (FIG. 3) of the duct 60 and outlet aperture 80 is generally at least twenty-five percent of the area of the speaker's cone 92 (FIG. 2). When the cross-sectional area 90 is at least generally twenty-five percent of the cone area 92, the acoustic resonance is minimized.

A noise, vibration and harshness (NVH) hat and/or acoustic resistive material may be added to the outlet aperture 80 or at the second end of the duct 60 to provide noise isolation from the outside atmosphere while allowing fluid communication between the speakers 34 and the outside environment. Even with the back side of the speaker in fluid communication with the open environment outside of the vehicle, unwanted resonance is significantly reduced while outside noise is minimized or prevent from entering the vehicle via the acoustic resistive material. Accordingly, sound quality in the bass-range is improved due to the reduced mechanical vibration as well as the multi-directional emission of the bass-range.

The vehicle 10 may also include a control unit that is in communication with each of the speakers 34. The audio control unit may manage bass and sound distribution that may be emitted outside of a vehicle via the duct 60, as described in International Patent Application No. PCT/US16/15393 by Harman International Industries, Inc., the disclosure of which is incorporated by reference herein. For example, the control unit may adjust the sound pressure level of the speakers 34 and/or redistribute bass-range emissions based on operation of the vehicle, such as the vehicle speed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An audio system for a vehicle comprising:

a bass-range speaker mounted in a vehicle cavity, the bass-range speaker having a front side for producing an acoustic output in a passenger compartment of the vehicle, wherein the vehicle cavity encloses a back side of the bass-range speaker; and a duct extending across a hinge area of a vehicle door, the duct having a first end in communication with the vehicle cavity and a second end being in fluid communication with the atmosphere outside the vehicle; and a grommet disposed in the hinge area of the vehicle door, wherein the grommet contains electrical wiring and at least a portion of the duct.

2. The audio system of claim 1, wherein the vehicle cavity is formed in the vehicle door.

3. The audio system of claim 2, wherein the grommet extends from a forward side of the vehicle door across a hinge area between the vehicle door and a body structure of the vehicle.

4. The audio system of claim 1, wherein the second end of the duct is positioned adjacent an opening formed in a wheel well of the vehicle.

5. The audio system of claim 1, wherein the second end of the duct is positioned in an engine compartment of the vehicle.

6. The audio system of claim 1, wherein the second end of the duct is in fluid communication with a B-pillar of the vehicle, wherein the B-pillar has an opening in fluid communication with the atmosphere outside the vehicle.

7. The audio system of claim 1, wherein the duct has a cross-sectional area being at least twenty-five percent of a cone area of the speaker, wherein the cross-sectional area of the duct is maintained in the grommet.

8. The audio system of claim 1, wherein the bass-range speaker is fluidly sealed between the first end and the second end.

9. The audio system of claim 1, wherein at least a portion of the duct is flexible.

10. An audio system for a vehicle comprising:

a speaker housing mounted in the vehicle;

a bass-range speaker mounted in the speaker housing for producing low frequency acoustic output from a front side of the bass-range speaker to a passenger compartment of the vehicle, the speaker housing enclosing a back side of the bass-range speaker; and a duct extending across a hinge area of a vehicle door, the duct having a proximal end extending to a distal end, the proximal end being fluidly sealed in the speaker housing and the distal end being in fluid communication with the atmosphere outside the vehicle;

a grommet disposed in the hinge area of the vehicle door, wherein the grommet contains electrical wiring and at least a portion of the duct.

11. The audio system of claim 10, wherein the speaker housing is not a sealed resonance volume.

12. The audio system of claim 10, wherein the bass-range speaker is mounted in the door of the vehicle and the duct extends from a forward side of the door across the hinge area between the vehicle door and a forward body structure, wherein the distal end is fluidly connected to the forward body structure of the vehicle being open to the atmosphere.

13. The audio system of claim 12, wherein at least one of the proximal end and the distal end of the duct is covered in an acoustic resistive material to minimize noise from the atmosphere in the passenger compartment of the vehicle.

14. The audio system of claim 10, wherein the duct has a cross-sectional area being at least twenty-five percent of a cone area of the speaker, wherein the cross-sectional area of the duct is maintained in the grommet.

15. The audio system of claim 10, wherein the duct is fluidly sealed between the proximal end and the distal end.

16. A method for arranging an audio system in a vehicle comprising:

mounting a speaker in a cavity in the vehicle;

providing a duct having a first end in fluid communication with the cavity and a second end in fluid communication with the atmosphere outside the vehicle;

routing at least a portion of the duct through a grommet extending in a hinge area between a vehicle door and a body structure; and routing electrical wiring through the grommet adjacent the portion of the duct.

17. The method of claim 16, wherein the speaker is mounted in a cavity in the vehicle door.

18. The method of claim 17, further comprising:

positioning the second end of the duct in an opening in the vehicle body formed in the wheel well.

19. The method of claim 16, wherein the duct has a cross-sectional area being at least twenty-five percent of a cone area of the speaker, wherein the cross-sectional area of the duct is maintained in the grommet.

* * * * *